US011707167B2

(12) United States Patent
Saubert

(10) Patent No.: US 11,707,167 B2
(45) Date of Patent: Jul. 25, 2023

(54) STICK VACUUM WITH INDEXING VACUUM HEAD ASSEMBLY

(71) Applicant: TRANSFORM SR BRANDS LLC, Hoffman Estates, IL (US)

(72) Inventor: Michael Saubert, Hoffman Estates, IL (US)

(73) Assignee: TRANSFORM SR BRANDS LLC, Hoffman Estates, IL (US)

( * ) Notice: Subject to any disclaimer, the term of this patent is extended or adjusted under 35 U.S.C. 154(b) by 1076 days.

(21) Appl. No.: 16/209,644

(22) Filed: Dec. 4, 2018

(65) Prior Publication Data

US 2019/0200821 A1 Jul. 4, 2019

Related U.S. Application Data

(60) Provisional application No. 62/594,328, filed on Dec. 4, 2017.

(51) Int. Cl.

| | |
|---|---|
| ***A47L 5/22*** | (2006.01) |
| ***A47L 9/22*** | (2006.01) |
| ***A47L 9/06*** | (2006.01) |
| ***A47L 5/28*** | (2006.01) |

(52) U.S. Cl.

CPC ..... *A47L 5/225* (2013.01); *A47L 5/28* (2013.01); *A47L 9/0673* (2013.01); *A47L 9/22* (2013.01); *A47L 9/0693* (2013.01)

(58) Field of Classification Search

CPC ..... A47L 5/225; A47L 9/0673; A47L 9/22; A47L 9/0693

USPC ..... 15/350, 328, 329, 344, 352

See application file for complete search history.

(56) References Cited

U.S. PATENT DOCUMENTS

| | | | | |
|---|---|---|---|---|
| 4,644,605 | A * | 2/1987 | Joss | A47L 5/225 15/329 |
| 2010/0229334 | A1* | 9/2010 | Conrad | A47L 9/009 15/353 |
| 2014/0237754 | A1* | 8/2014 | Conrad | A47L 5/225 15/328 |
| 2017/0303754 | A1* | 10/2017 | Conrad | A47L 9/1683 |
| 2019/0125147 | A1* | 5/2019 | Svantesson | A47L 5/225 |
| 2019/0357740 | A1* | 11/2019 | Thorne | A47L 5/24 |

* cited by examiner

*Primary Examiner* — Michael D Jennings
*Assistant Examiner* — Shantese L McDonald
(74) *Attorney, Agent, or Firm* — McAndrews, Held & Malloy, Ltd.

(57) ABSTRACT

Systems and methods for providing a vacuum cleaner with sliding vacuum head assembly. The vacuum head assembly comprises, for example, a vacuum motor, a dust bin, and a fan. The vacuum clean is configured for cleaning high and low surfaces based on a position of the vacuum head assembly along the vacuum tube.

12 Claims, 5 Drawing Sheets

STICK VACUUM WITH INDEXING VACUUM HEAD ASSEMBLY

RELATED APPLICATIONS/INCORPORATION BY REFERENCE

The present application claims benefit from and priority to U.S. Application No. 62/594,328, filed Dec. 4, 2017. The above-identified application is hereby incorporated herein by reference in its entirety.

FIELD OF THE DISCLOSURE

Certain embodiments of the disclosure relate to systems and methods for providing a vacuum system and, in particular, a vacuum system with an indexing vacuum head assembly.

BACKGROUND OF THE DISCLOSURE

Conventional stick vacuums are designed for floor cleaning. However, such designs are not flexible and do not work well in other cleaning situations such as, for example, cleaning ceilings.

Further limitations and disadvantages of conventional and traditional approaches will become apparent to one of skill in the art, through comparison of such systems with the present disclosure as set forth in the remainder of the present application with reference to the drawings.

BRIEF SUMMARY OF THE DISCLOSURE

Systems, devices, and methods for providing a vacuum system with an indexing vacuum head assembly are provided substantially as illustrated by and/or described in connection with at least one of the figures, as set forth more completely in the claims.

Various advantages, aspects and novel features of the present disclosure, as well as details of an illustrated embodiment thereof, will be more fully understood from the following description and drawings.

DETAILED DESCRIPTION OF THE DISCLOSURE

As utilized herein the terms "circuit" and "circuitry" refer to physical electronic components (i.e., hardware) and any software and/or firmware ("code") which may configure the hardware, be executed by the hardware, and/or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations.

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated.

Some embodiments of the present disclosure relate to systems, methods, and devices for providing a vacuum system with an indexing vacuum head assembly.

Figure 1:
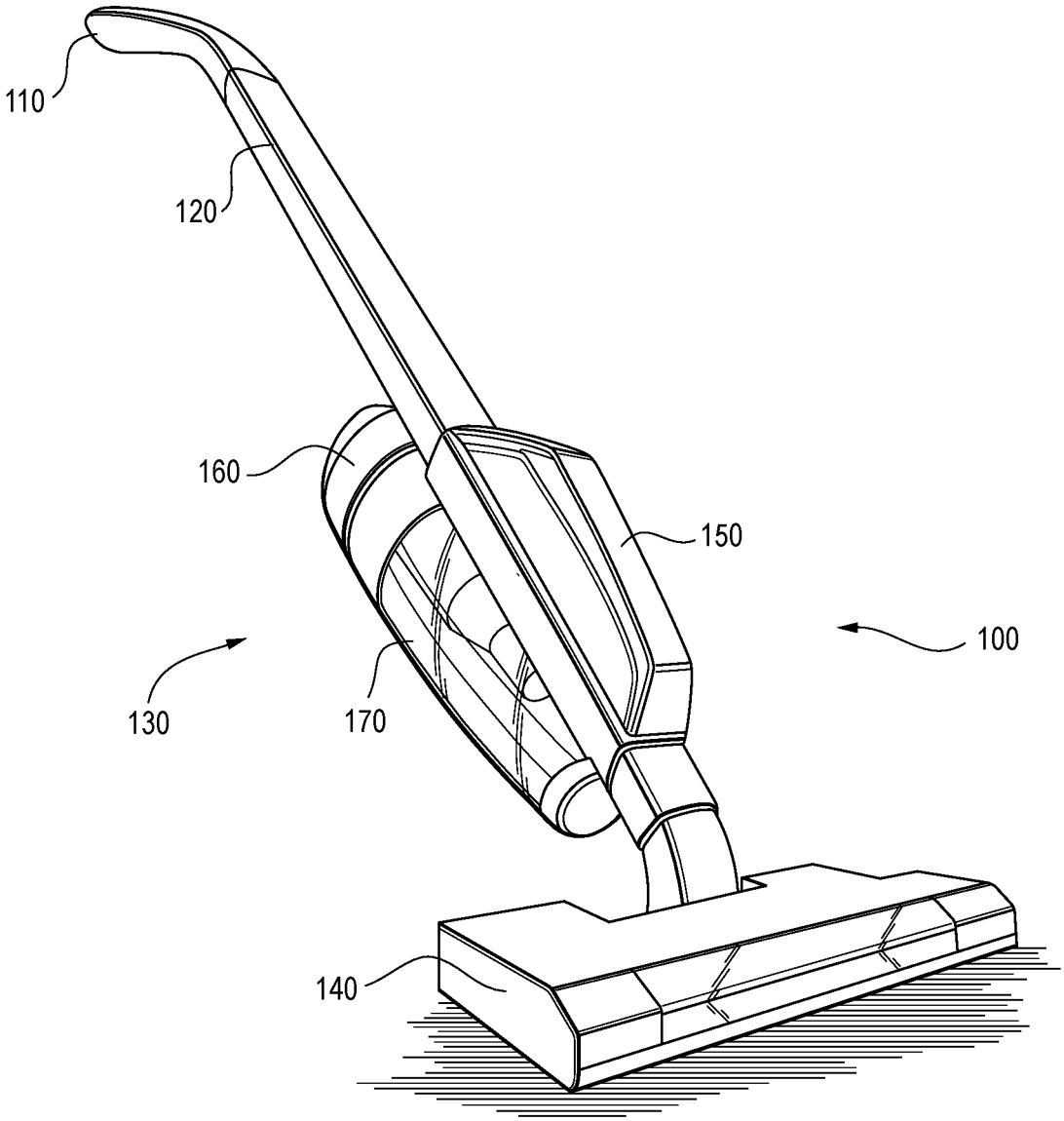
FIG. 1 shows an embodiment of a vacuum cleaner according to the present disclosure.

FIG. 1 shows an embodiment of a vacuum cleaner 100 according to the present disclosure. Although illustrated as a stick vacuum cleaner, some embodiments contemplate different form factors and/or types of vacuum cleaners and are within the scope of the present disclosure. Referring to FIG. 1, the vacuum cleaner 100 can include, for example, a handle 110, a wand 120 (e.g., a main vacuum tube), a vacuum head assembly 130, and a nozzle 140. The vacuum head assembly 130 can include, for example, a handle 150, a vacuum motor 160, and a dust cup 170.

In operation, the vacuum head assembly 130 can slide to preset locations (e.g., indexed locations) along the wand 120 (e.g., the main vacuum tube) to provide different configurations for vacuum cleaner 130. In some embodiments, the vacuum cleaner 100 can be a light weight, stick vacuum cleaner with the ability to convert from floor use to overhead ceiling use by sliding the vacuum head assembly 130 including the vacuum motor 160 along the wand 120. As shown in FIG. 1, the vacuum head assembly 130 can slide toward a preset bottom position along the wand 120. This bottom position is ergonomically advantageous for floor cleaning, for example, using the floor nozzle 140. In the bottom position, the weight of the vacuum head assembly 130 rests primarily over the nozzle 140. Accordingly, the user can achieve a better ease of use as the weight of the vacuum head assembly 130 is closer to the floor and away from the user's hand when in use. With the vacuum head assembly 130 closer to the ground in proximity to the nozzle 140, a shorter suction air path is achieved, thereby improving suction and cleaning. In addition, with the weight of the vacuum head assembly 130 over (e.g., directly over or substantially over) the nozzle 140, more pressure can be applied to the nozzle 140, thereby achieving an improved seal with the cleaning surface (e.g., carpeted floor, hardwood floor, etc.) which results in better suction, agitation, and/or cleaning.

The vacuum head assembly 130 can also slide up along the wand 120 to another other preset positions that might be ergonomically advantageous for other types of cleaning that might use other types of nozzles 140. Some embodiments provide that the vacuum head assembly 130 can also slide up along the wand 120 to a particular preset position that might be ergonomically advantageous for ceiling cleaning using the same or a different type of nozzle 140. For example, with the weight of the vacuum head assembly 130 distributed closest to the hand and wrist of the user, maximum maneuverability (e.g., ease of maneuverability, optimal control, lower center of gravity, etc.) for the user is achieved for cleaning overhead surfaces. Further, in this configuration, an overhead cleaning motion using the vacuum cleaner 100 is less taxing on arm muscles of the user. Other preset positions can be indexed in the wand 120 for ceiling cleaning or other types of surfaces depending on the size, reach, and/or height of the operator and/or the height of the ceiling and/or surface being cleaned.

Some embodiments provide that the user does not have to detach and re-attach tube sections of the wand 120 to reconfigure the vacuum cleaner 100. Instead, the vacuum cleaner 100 can be reconfigured by allowing the vacuum head assembly 130 to move (e.g., move longitudinally) along the wand 120 (e.g., the main vacuum tube) and to index into its preset locations. The vacuum cleaner 100 can thereby be used to clean an entire room by converting the vacuum cleaner 100 as needed to perform the specific cleaning job (e.g., cleaning floor, ceiling, shelves, etc.). Some vacuum cleaners 100 can be equipped with and/or adapted for a duster and/or a duster vacuum nozzle, for example.

FIGS. 2-5 show embodiments of various configurations of the vacuum cleaner 100 according to the present disclosure.

Figure 2:
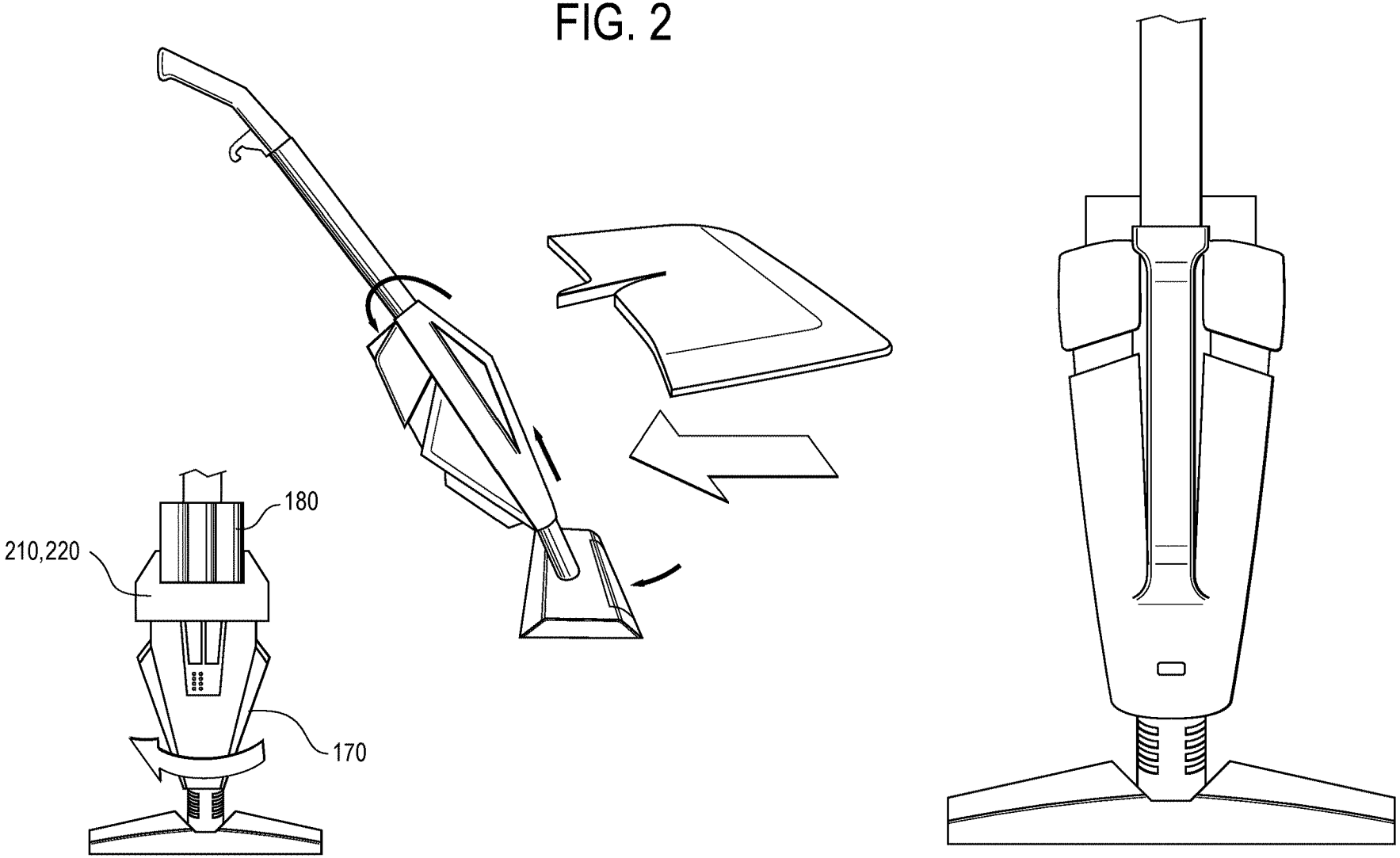
FIG. 2 shows various views of an embodiment of the vacuum cleaner according to the present disclosure.
Figure 3:
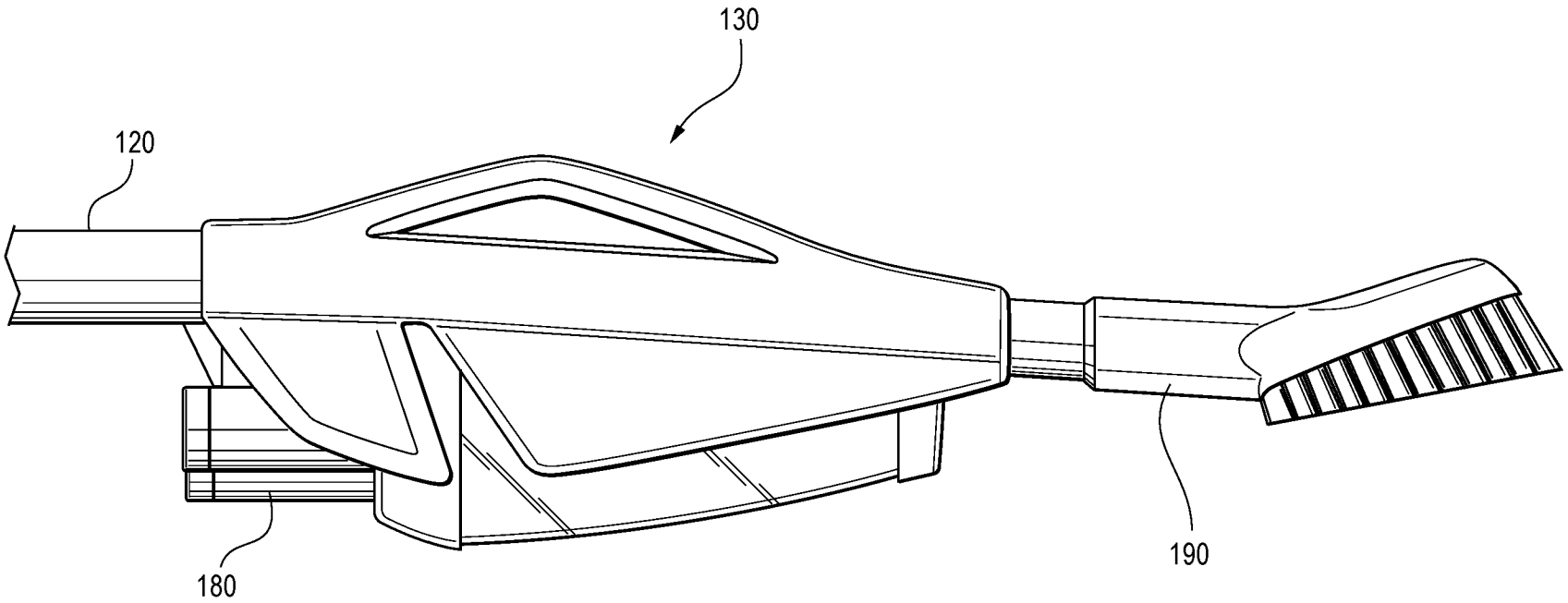
FIG. 3 shows an exemplary configuration of the vacuum cleaner according to the present disclosure.

FIG. 2 shows various views of an embodiment of the vacuum cleaner 100 according to the present disclosure. Referring to FIG. 2, the vacuum head assembly 130 is shown comprising one or more rechargeable batteries 180 (e.g., a removable battery pack), a fan 210, a turbo motor housing 220, and a twist off dust bin 170. Power and/or battery status can be shown via one or more light emitting diodes (LEDs) or a graphical display. In this floor cleaning configuration, air flow path is at its shortest from the nozzle 140 through a lower portion of the wand 120 to the vacuum head assembly 130. Some embodiments provide that, in this floor cleaning configuration, the portion of the wand 120 that is above the vacuum head assembly 130 is not in the air flow path during operation. The shorter air flow path results in better suction, agitation, and/or cleaning FIG. 3 shows an exemplary configuration of the vacuum cleaner 100 according to the present disclosure. Referring to FIG. 3, in this configuration, an accessory nozzle 190 can replace the nozzle 140. With the vacuum head assembly 130, the operator can use, for example, the handle 150 for greater maneuverability in cleaning stairs, doors, and/or shelves, for example. Although the vacuum head assembly 130 is positioned on the wand 120 near the accessory nozzle 190, the vacuum head assembly 130 can also slide along the wand 120 to the end of the wand 120, as shown in FIG. 5, into a ceiling cleaning configuration, for example.

Figure 4:
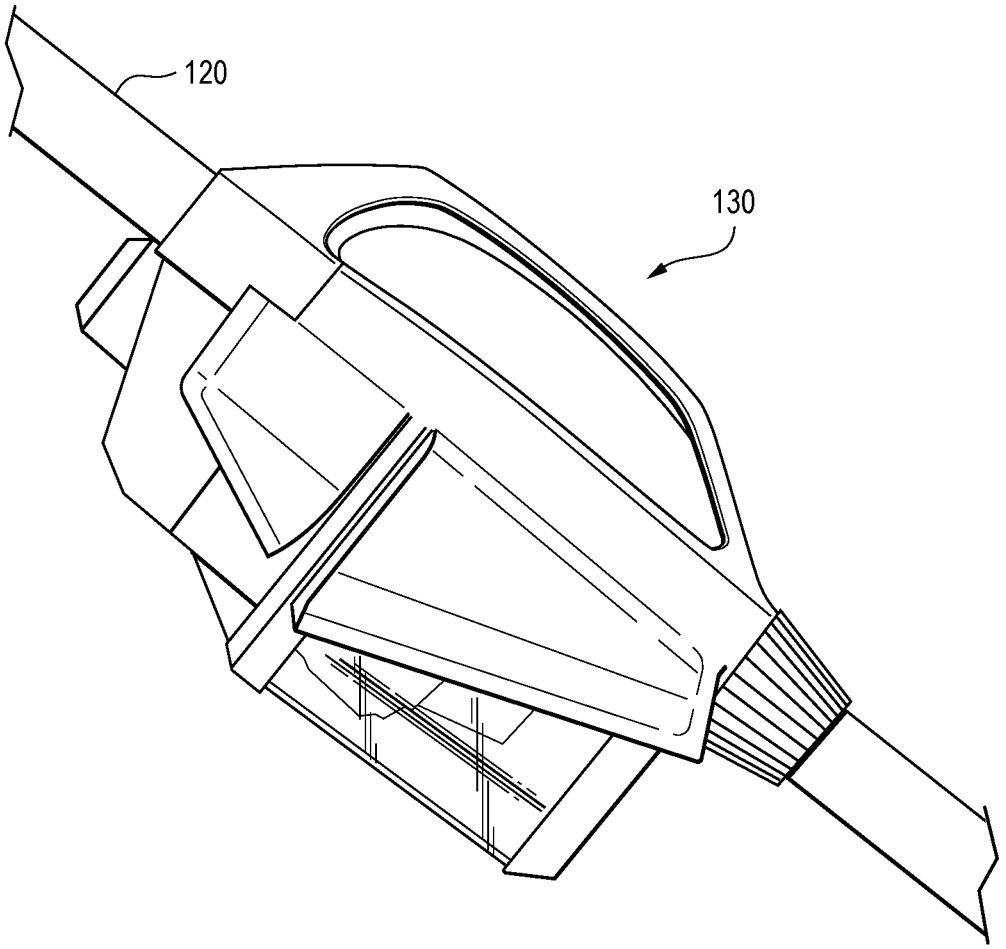
FIG. 4 shows an embodiment of a vacuum head assembly in combination with a wand according to the present disclosure.

FIG. 4 shows an embodiment of the vacuum head assembly 130 and its relationship with the wand 120 (e.g., the main vacuum tube). As shown, depending on the placement of the vacuum head assembly 130, the length of the air path is shortened or lengthened, resulting in a decrease or increase in suction, for example. In addition, valves can be actuated when the vacuum head assembly 130 is positioned at preset positions, thereby allowing air flow communication between the wand 120 and the vacuum head assembly 130. Some embodiments provide that the vacuum head assembly 130 can sense where it is located on the wand 120 and adjust its vacuum power to amplify, diminish, or compensate for the decrease or increase in suction due to the shortened or lengthened air path.

Figure 5:
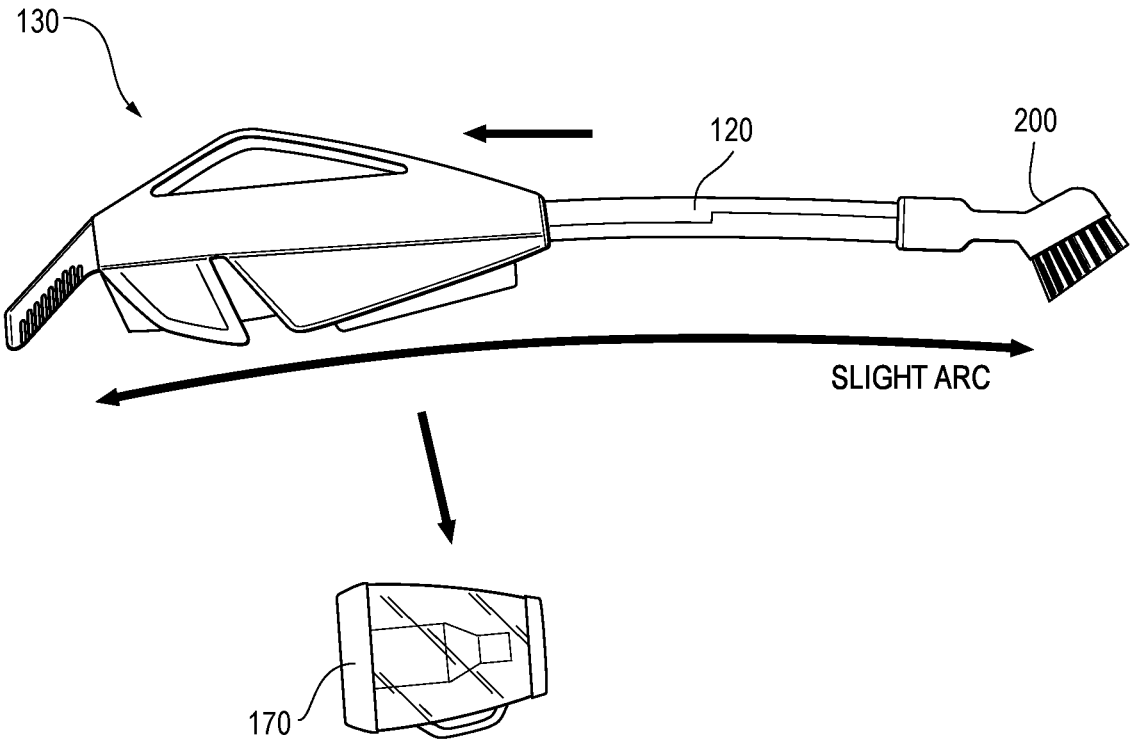
FIG. 5 shows another exemplary configuration of the vacuum cleaner according to the present disclosure.

FIG. 5 shows another exemplary configuration of the vacuum cleaner 100 according to the present disclosure. Referring to FIG. 5, the vacuum head assembly 130 has been moved to the end of the wand 120, thereby maximizing the air path length. Another accessory nozzle 200 is attached to the end of the wand 120 for cleaning ceilings, high shelves, or other high surfaces. Further, the wand 120 has a slight arc for ease of use such as, for example, reaching high shelves or the tops of surfaces such as, for example, doorways or entrances. In addition, the dust cup 170 is configured to be easily removed (e.g., drops or pops out) for emptying.

Some embodiments enable a vacuum cleaner system (e.g., a stick vacuum system) to quickly convert from a motor-at-the-top handle position to a motor-at-the-floor position to enhance usability when cleaning dusty surfaces of a room from top to bottom. The vacuum head assembly including the vacuum motor slides along the main vacuum tube and, through the use of catches (e.g., button catches) and releases, valves open or close at the respective ends of the tube which enables airflow to occur. Some embodiments provide that the vacuum head assembly and the main vacuum tube are only in flow communication when the vacuum head assembly is positioned at indexed or preset locations along the main vacuum tube. In some embodiments, such a configuration allows for only one length of vacuum tube to be used for every cleaning scenario (e.g., cleaning at different heights and/or angles). This allows for convenience of use for the user and optimizes product ergonomics for the particular cleaning task being performed. Some embodiments provide that the vacuum tube can change in length by extending or compressing tube segments.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A system, comprising:

a vacuum head assembly operatively coupled to a vacuum tube of a vacuum cleaner, wherein:

the vacuum head assembly comprises a vacuum motor, the vacuum head assembly is movable along a length of the vacuum tube, the vacuum head assembly comprises a handle, the handle is substantially parallel to the vacuum tube, and the vacuum motor and the handle are positioned on opposite sides of the vacuum tube, and the vacuum head assembly is operably slid to various positions along the vacuum tube.

2. The system according to claim 1, wherein the vacuum head assembly comprises a dust container.

3. The system according to claim 1, wherein the vacuum head assembly comprises one or more rechargeable batteries.

4. The system according to claim 1, wherein vacuum head assembly comprises a fan.

5. The system according to claim 1, wherein the vacuum head assembly is movable along the length of the vacuum tube to preset locations, wherein the vacuum head assembly is in flow communication with the vacuum tube at the preset locations.

6. The system according to claim 1, wherein the vacuum head assembly is movable along the length of the vacuum tube to preset locations, wherein the vacuum head assembly is in flow communication with the vacuum tube only at the preset locations.

7. A vacuum cleaner, comprising:

a vacuum head assembly operatively coupled to a vacuum tube of a vacuum cleaner, wherein:

the vacuum head assembly comprises a vacuum motor, the vacuum head assembly is slidable along the vacuum tube, and the vacuum head assembly comprises a handle, the handle is substantially parallel to the vacuum tube, the vacuum motor and the handle are positioned on opposite sides of the vacuum tube, and the vacuum head assembly is operably slid to various positions along the vacuum tube.

8. The vacuum cleaner according to claim 7, wherein the vacuum head assembly comprises a dust container.

9. The vacuum cleaner according to claim 7, wherein the vacuum head assembly comprises one or more rechargeable batteries.

10. The vacuum cleaner according to claim 7, wherein vacuum head assembly comprises a fan.

11. The vacuum cleaner according to claim 7, wherein the vacuum head assembly is slidable along the length of the vacuum tube to preset locations, wherein the vacuum head assembly is in flow communication with the vacuum tube at the preset locations.

12. The vacuum cleaner according to claim 7, wherein the vacuum head assembly is slidable along the length of the vacuum tube to preset locations, wherein the vacuum head assembly is in flow communication with the vacuum tube only at the preset locations.

* * * * *